United States Patent [19]

Orban

[11] Patent Number: 4,645,574

[45] Date of Patent: Feb. 24, 1987

[54] CONTINUOUS PROCESS FOR THE SEQUENTIAL COATING OF POLYAMIDE FILAMENTS WITH COPPER AND SILVER

[75] Inventor: Ralph F. Orban, Columbus, Ohio

[73] Assignee: Material Concepts, Inc., Columbus, Ohio

[21] Appl. No.: 729,827

[22] Filed: May 2, 1985

[51] Int. Cl.[4] ..... C23C 18/30

[52] U.S. Cl. ..... 204/14.1; 8/139; 427/305; 427/322; 427/306; 204/21; 204/38.4; 204/40

[58] Field of Search ..... 427/304–306, 427/322; 428/263, 267; 8/139; 204/14.1, 21, 38.4, 40

[56] References Cited

U.S. PATENT DOCUMENTS

| | | | |
|---|---|---|---|
| 3,686,019 | 8/1972 | Ohfuka | 427/306 |
| 3,801,478 | 4/1974 | Heger | 428/263 |
| 3,967,010 | 6/1976 | Maekawa | 427/307 |
| 4,002,779 | 1/1977 | Nischwitz | 427/306 |
| 4,042,737 | 8/1977 | Forsgren | 427/304 |
| 4,169,171 | 9/1979 | Narcus | 427/404 |
| 4,340,382 | 7/1982 | Morlino | 8/139 |
| 4,362,779 | 12/1982 | Arsac | 428/263 |

FOREIGN PATENT DOCUMENTS

| | | | |
|---|---|---|---|
| 2437157 | 2/1975 | Fed. Rep. of Germany | 427/304 |
| 2820502 | 11/1979 | Fed. Rep. of Germany | 427/304 |
| 2063291 | 7/1971 | France | 427/305 |
| 1264423 | 2/1972 | Japan | 427/304 |
| 48-318 | 1/1973 | Japan | 427/306 |
| 49-126999 | 12/1974 | Japan | 427/304 |

*Primary Examiner*—John D. Smith
*Attorney, Agent, or Firm*—John L. Gray

[57] ABSTRACT

A method of continuously sequentially coating polyamide filaments with copper and silver which utilizes as a key step in the process the use of a wetter solution containing alcohol, a detergent and an ethylene oxide and propylene oxide copolymer surfactant. The filaments are in the form of multi-filament tows, roving, woven tape or fabric and the steps involve immersing the filaments in a sodium hydroxide trisodium phosphate cleaning solution, followed by a water rinse and then immersion in the wetter solution, followed by water rinse and then followed by a conventional commercial pre-activator, then a commercial palladium chloride/stannous chloride catalytic activator, followed by commercial autocatalytic copper plating as a first copper plating step, followed by a subsequent copper plating step from a copper cyanide bath, followed by a conventional silver plating step, with appropriate water rinses after each of the plating steps, and finally with an alcohol rinse and drying.

4 Claims, 1 Drawing Figure

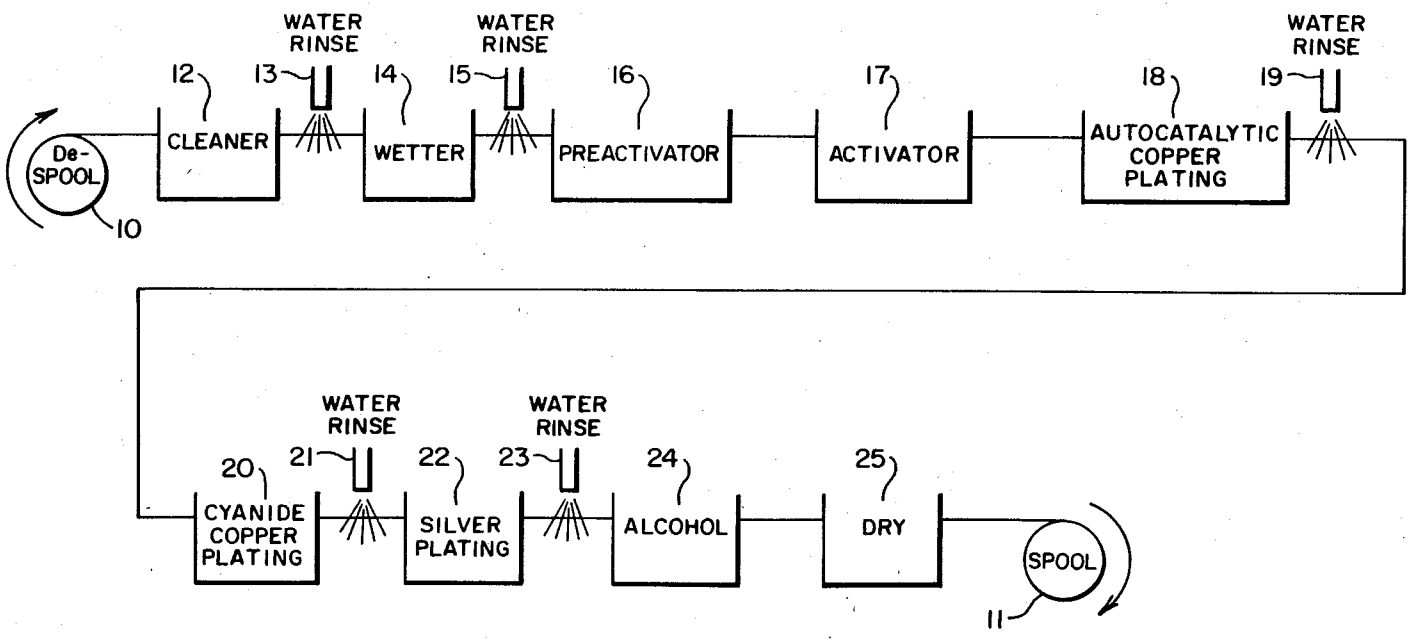
De-SPOOL
10
12
CLEANER
WATER RINSE
13
14
WETTER
WATER RINSE
15
16
PREACTIVATOR
17
ACTIVATOR
18
AUTOCATALYTIC COPPER PLATING
WATER RINSE
19
20
CYANIDE COPPER PLATING
WATER RINSE
21
22
SILVER PLATING
WATER RINSE
23
24
ALCOHOL
25
DRY
SPOOL
11

CONTINUOUS PROCESS FOR THE SEQUENTIAL COATING OF POLYAMIDE FILAMENTS WITH COPPER AND SILVER

BACKGROUND OF THE INVENTION

A number of processes for the coating of polyamides with metal exist in the prior art. For example, reference is made to U.S. Pat. No. 3,607,353, Abu-Isa, U.S. Pat. No. 3,877,965, Broadbent, and U.S. Pat. No. 3,967,010, Maekawa.

Much of the prior art is directed to batch processes, or long processing times, such as 16 hours or overnight.

SUMMARY OF THE INVENTION

The invention permits the continuous application of copper followed by silver on polyamide filaments, usually in the form of multi-filament tows, roving, woven tape or fabric in a relatively short period of time, slightly over 30 minutes. The process involves the use of a wetter solution following the initial cleaning step. Use of this wetter solution is critical to the operation of the process. The wetter solution is a mixture of alcohol, which preferably is isopropyl alcohol, a detergent and a surfactant, where the surfactant is an ethylene oxide and propylene oxide copolymer. The particular surfactant that has been used is sold by BASF Wyandott under the Pluronic series trademark.

It is therefore an object of this invention to coat polyamide filaments with sequential coatings of copper and silver.

It is also an object of this invention to coat such filaments in the form of multi-filament polyamide tows, roving, woven tape or fabric with sequential coatings of copper and silver so that the resultant product is electrically conductive.

It is a further object of this invention to provide such a process which is a continuous process.

These, together with other objects and advantages of the invention, should become apparent in the details of construction and operation, as more fully described herein and claimed, reference being had to the accompanying drawing forming a part hereof wherein like numerals refer to like parts throughout.

BRIEF DESCRIPTION OF THE DRAWING

The drawing is a flow chart of the processing steps involved in practicing the invention.

DETAILED DESCRIPTION OF THE INVENTION

Referring now more particularly to the drawing, the multifilament polyamide tow, roving, woven tape or fabric is wound on the spool 10 and unwound from the spool 10 by the action of windup spool 11 and continuously moved through the various processing steps at prescribed residence times using conventional sealing techniques.

The first step involves immersing the polyamide filaments in the cleaner solution shown at 12. This cleaner solution preferably is a mixture of sodium hydroxide and trisodium phosphate. This step is then followed by a water rinse 13, followed by immersing the filaments in a wetter solution 14 comprising water and isopropyl alcohol containing a detergent and a small amount, in the order of one half to one percent, of ethylene oxide and propylene oxide copolymer surfactant, followed by a water rinse 15. The polyamide filaments are then immersed in the pre-activator 16, A satisfactory pre-activator is a solution sold by Fidelity Chemical Company under the designation No. 1017 Fidelity Activator Salts. It is believed to be composed of one or more of the following: ferrous sulfate, sulfamic acid, and ammonium bifluoride. This is then followed by immersing in activator 17, which comprises palladium chloride/stannous chloride catalytic activator. The residence time in the cleaner solution 12 usually is about one minute at 50° C., the residence time in the pre-activator is about three minutes. The residence time in the activator 17 is from 30 seconds to one minute. The polyamide filaments then are introduced into the autocatalytic copper plating bath 18 for a period of from five to 20 minutes, followed with a water rinse 19 and then introduced into the copper cyanide plating bath 20, which involves a residence time of about two minutes, followed by a water rinse 21. Then the copper-coated filaments are introduced into silver plating bath 22 for from two, to four minutes. This bath is a conventional silver cyanide plating bath. There follows a water rinse 23, an alcohol rinse 24, preferably with isopropyl alcohol, drying step 25, and then spooling on spool 11.

The following examples will illustrate the advantages of the invention. In each of these examples, the following steps were followed for the residence time and temperatures noted:

1. Cleaner of sodium hydroxide, trisodium phosphate at 50° C. for one minute.
2. Water rinse.
3. One minute residence in wetter solution comprising a mixture of isopropyl alcohol, a detergent and an ethylene oxide and propylene oxide copolymer surfactant, which surfactant is one percent by volume of the wetter solution.
4. Water rinse.
5. Immerse in pre-activator for three minutes.
6. Immerse in commercial palladium chloride/stannous chloride catalytic activator for from 30 seconds to one minute.
7. Deposit copper from a commercial autocatalytic copper solution for from five to 20 minutes.
8. Water rinse.
9. Deposit additional copper over the copper-coated polyamide filaments with conventional copper cyanide plating bath for two minutes.
10. Water rinse.
11. Deposit silver over the multi-copper-coated polyamide filaments from a conventional silver cyanide bath with a residence time of from two to four minutes.
12. Water rinse.
13. Isopropyl alcohol rinse.
14. Drying.

EXAMPLE 1

Utilizing the above process steps with the filament transport system set to produce the desired residence times in the specific solutions, a polyamide (nylon 66) woven tape was processed according to the specified steps. Upon immersion in the autocatalytic copper bath, a copper deposit appeared within three minutes and the woven tape became conductive enough after ten minutes to deposit copper from a high-speed copper cyanide bath. The resultant copper deposits were smooth, shiny and exhibited good adherence. Upon immersion in a silver cyanide bath, the copper was entirely covered with metallic silver which was smooth and exhibited good adherence.

EXAMPLE 2

The same conditions and substrate were utilized as in Example 1, only the preactivation step was eliminated and the activator was dissolved in ethyl alcohol. The autocatalytic copper bath did not deposit any copper.

EXAMPLE 3

The same conditions as in Example 1 were employed except a 50 percent hydrochloric acid accelerator step was added after the activation step. The autocatalytic bath did not deposit any copper.

EXAMPLE 4

The same conditions as in Example 1 were employed except that the wetter solution was not used. The substrate material appeared to coat completely but as it dried, the copper oxidized off the substrate.

It will thus be seen that by practicing this invention, good quality adherent coatings of silver on copper on multi-filament tows, roving, woven tape or fabric of polyamide may be obtained.

While this invention has been described in its preferred embodiment, it is appreciated that variations thereon may be made without departing from the true scope and spirit of the invention.

What is claimed is:

1. A method of continuously coating polyamide filaments in the form of multi-filament tows, roving, woven tape or fabric with metal comprising the steps of:

immersing said filaments in a cleaning solution,
rinsing said filaments with water,
immersing said filaments in a wetter solution containing alcohol, a detergent and an ethylene oxide and propylene oxide copolymer surfactant,
rinsing said filaments with water,
treating said filaments with a pre-activator,
treating said filaments with an activator selected from the group consisting of palladium chloride and stannous chloride,
coating said filaments with copper from an autocatalytic copper solution,
rinsing said filaments with water,
coating said copper coated filaments with additional copper from a copper cyanide bath,
rinsing said filaments with water,
coating said copper-coated filaments with silver from a silver cyanide bath,
rinsing said filaments with water,
rinsing said filaments with alcohol,
drying said filaments.

2. The method of claim 1 wherein the cleaning solution comprises a mixture of sodium hydroxide and trisodium phosphate.

3. The method of claim 2 wherein said alcohol is isopropyl alcohol.

4. The method of claim 1 wherein said surfactant is from one-half to one percent of said wetter solution.

* * * * *